United States Patent [19]

Nothmann

[11] 4,168,092

[45] Sep. 18, 1979

[54] MULTIPLE PAPER STACK UNLOADER

[75] Inventor: Gerhard A. Nothmann, Wilmette, Ill.

[73] Assignee: AM International, Inc., Los Angeles, Calif.

[21] Appl. No.: 814,219

[22] Filed: Jul. 11, 1977

[51] Int. Cl.[2] ..... B65G 7/12

[52] U.S. Cl. ..... 294/87 R; 414/267

[58] Field of Search ..... 294/87, 87 A, 87.22, 294/87.24; 271/173; 214/16.6

[56] References Cited

U.S. PATENT DOCUMENTS

| | | | |
|---|---|---|---|
| 2,907,479 | 10/1959 | Cunningham | 214/16.6 |
| 4,068,882 | 1/1978 | van der Schoot | 294/87 A |

*Primary Examiner*—James B. Marbert

*Attorney, Agent, or Firm*—George Jameson; Michael A. Kondzella; Ray S. Pyle

[57] ABSTRACT

The device shown is a dual purpose unloader for the sheet holder bins of a paper distribution system, such as a collator. The bins of a collator are sometimes sloped to allow gravitational settling of the sheets as they are fed into the pockets. The illustrated unloader is an elongated open channel with an internal slidable rod. One set of grippers is mounted on the open channel and another set of grippers on the rod. A spring urges the two sets to move into a gripper closed position, and manual handles provide a means for opening the set of grippers. A mounting frame is available for guiding the unloader into proper registration with the collator pockets if manual placement is not convenient or desired.

6 Claims, 6 Drawing Figures

10
40
12
32
42
22
36
14
15
34
42
12

16
20
18

24
26
28
30

MULTIPLE PAPER STACK UNLOADER

BACKGROUND OF THE INVENTION

Office copying, duplicating, and similar reproduction is carried out in a multitude of equipment configurations. However, almost universally, the reproduction process results in paper sheets which ultimately come to a pocket holding device wherein shelves are placed one above the other in order that the distribution device can project the sheets into the area between two shelves, normally referred to as a pocket or compartment.

Conventionally, the shelves are notched in order that the operator is able to grip a stack of sheets placed in a particular pocket without the need to pry under a stack.

Although there are mechanical devices to feed sheets one at a time out of collator holding bin structure, the removal of an entire stack from a pocket is generally accomplished manually.

Manual removal of stacks of sheets from pockets is a relatively slow procedure and while it is being done the collecting pockets cannot be used for a new run from the source projecting sheets into the collector pocket. Hence, if that source is a production machine, the machine is down while the previous run is being removed. Of course, a second or third collecting bin is sometimes available, but even so it is a slow labor procedure to remove the stacks from a collator collecting bin unit. For example, there may be 50 or more pockets in one unit, and unloading those pockets one at a time is labor-time consuming.

SUMMARY OF THE INVENTION

The purpose of this invention is to enable the simultaneous removal of sheet stacks from a multiple number of pockets rapidly and efficiently.

An object of the invention is to provide a gang of mechanical grippers which may be operated simultaneously to grasp a multiple number of stacks and to remove those stacks all in one motion.

IN THE DRAWING

FIG. 1 shows a simulated bin stack of a collator 10 as commonly used in the industry. The many available brands of paper sheet collectors are in many configurations, but essentially a frame of some type is designed to hold trays 12 which are sheet metal members hooked on either side to the frame for support.

The plurality of trays, each one of which is a support for sheets piled on top of that tray, define spaces which are generally referred to as pockets. Each tray has a finger notch 15 cut away in order that when sheets are accumulated on the tray surface, the operator is able to place a thumb and finger top and bottom of the stack.

Figure 2:
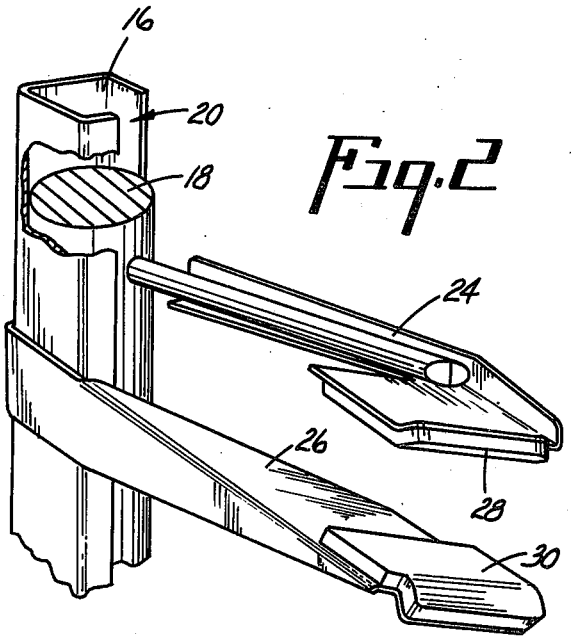
FIG. 2 is a detail of a single gripper arm set and supporting frames interlocked for longitudinal shiftable relative movement.

Referring to FIG. 2, there is shown a detail of the mechanical device according to this invention which has been created to provide a gang of mechanical fingers which replace the human fingers, which can normally grip no more than two or three stacks of sheets at one time. In the FIG. 2, an external open channel frame 16 and an internal cylindrical frame 18 are first and second elongated frames with the cylindrical frame 18 within the confines of the frame 16 for longitudinally shiftable relative movement. The frame 16 is considered to be a open channel member because an opening 20 across one corner gives access to the internal frame 18, but is closed sufficiently to retain the frame 18.

Figure 3:
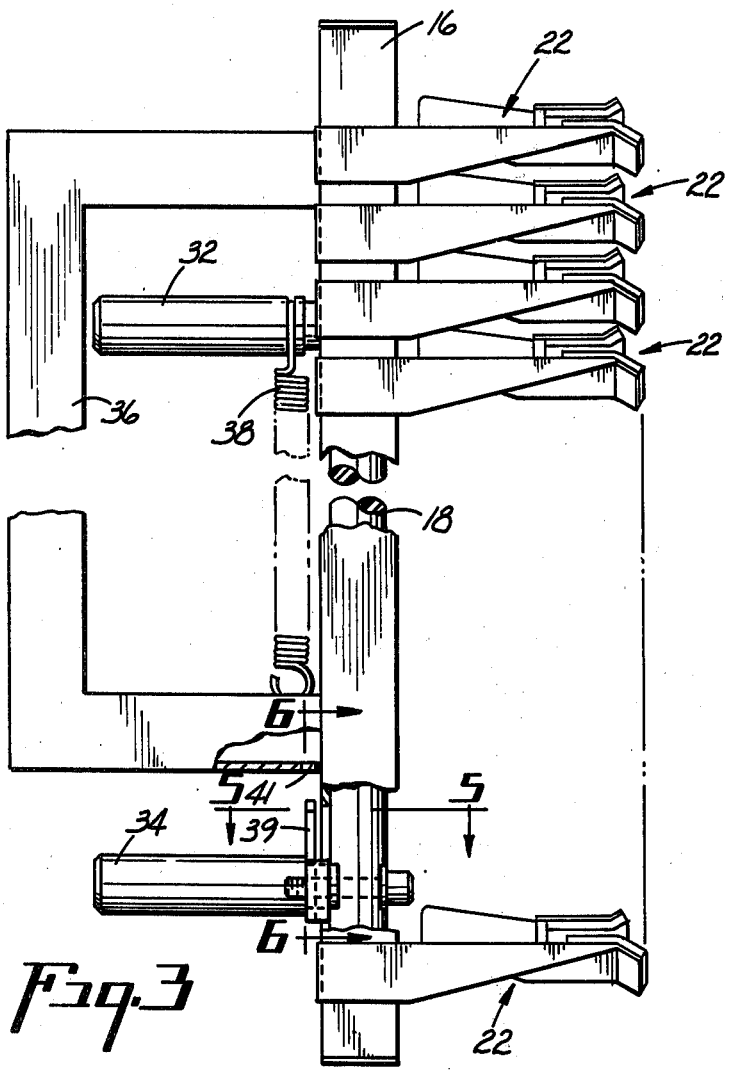
FIG. 3 is a side elevation of the unloader device of this invention.
Figure 4:
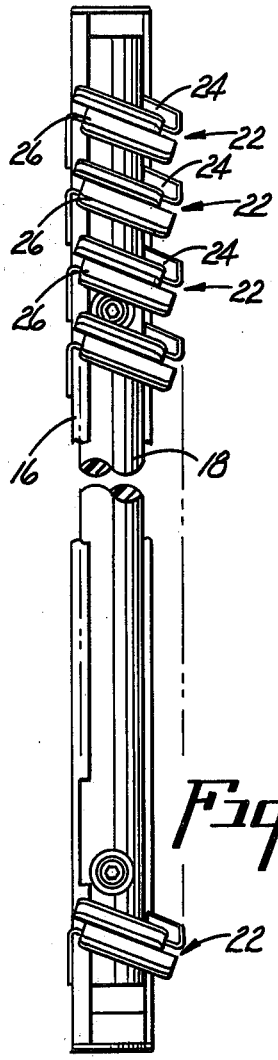
FIG. 4 is a front elevation of the unloader device.
Figure 5:
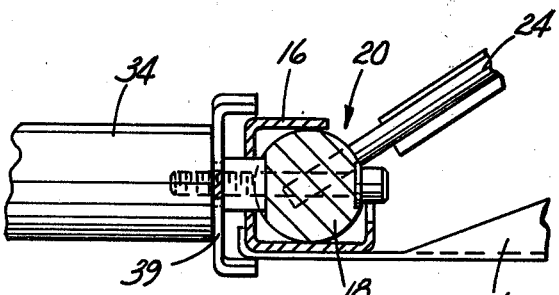
FIG. 5 is a detail taken through section 5—5 of FIG. 3.

There are a plurality of gripper arm sets 22 indicated by the reference number in FIG. 3, but the individual structure is shown best in FIG. 2. In FIG. 2, an arm 24 and an arm 26 are carried by the internal frame 18 and the external frame 16 respectively. The arms 24 and 26 are configured to give strength and support. The terminal portions of arms 24 and 26 are sloped in this embodiment to cooperate with a sloped tray configuration. The terminals will be configured to cooperate with the trays of the collator, whether flat or sloped. Pads 28 and 30 are carried at the terminal portions to provide good frictional contact with the stacks of sheets and to compensate for slight variations of stack thickness and mechanical tolerances of the unloader.

The terminal portions of arms 24 and 26 and the pads 28 and 30 are dimensioned to fit within the finger notches 15.

Two handles 32 and 34 are mounted to the frame 18 as illustrated in FIG. 3. Openings in the back of the open channel frame 16 permit movement of the handles with respect to the frame 16. A grip yoke 36 is secured to the frame 16 and a spring 38 secured from the handle 32 to the yoke 36 to provide a resilient urge of the handle 32, and hence the frame 18, in a direction to close the pads 28 and 30 together.

By grasping the handles 32 and 34 and pressing them toward the adjacent yoke 36, the individual pads 28 and 30 open against the urge of the spring 38 to enable the pads to be inserted above and below all the stacks of paper on the plurality of trays. Normally, those sections of yoke 36 which are parallel to the handles 32 and 34 are employed as cooperating grip members whereby the operator may use fingers around one of the cooperating handles and thumb around the other to facilitate easy movement of the frame 18 with respect to the frame 16. Then, after the unloader is in position, the handles may be released and the spring 38 will cause the grippers to provide full gripping action upon the sheets without the attention of the operator.

Figure 6:
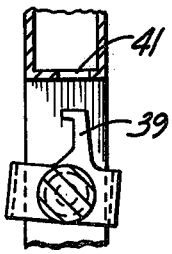
FIG. 6 is a modified section taken on line 6—6 of FIG. 3.

FIG. 6, taken along line 6—6 of FIG. 3, has an added accessory supplied to the FIG. 6 not shown in FIG. 3. Because the spring 38 is relatively strong to provide ample gripping action, it is difficult to maintain an open condition of the unloader for any period of time. Therefore, a detent device is provided to hold the device in the open-ready position until the pads are in correct position with respect to the stacks in the collator for gripping. An easily engaged and disengaged pivoted hook 39 is illustrated in FIG. 6 which may be spring-urged in a counterclockwise direction (spring not illustrated) to engage into latch opening 41 and may be readily disengaged by finger action to rotate in a clockwise direction when it is desired to release the device to close upon the stacks.

Figure 1:
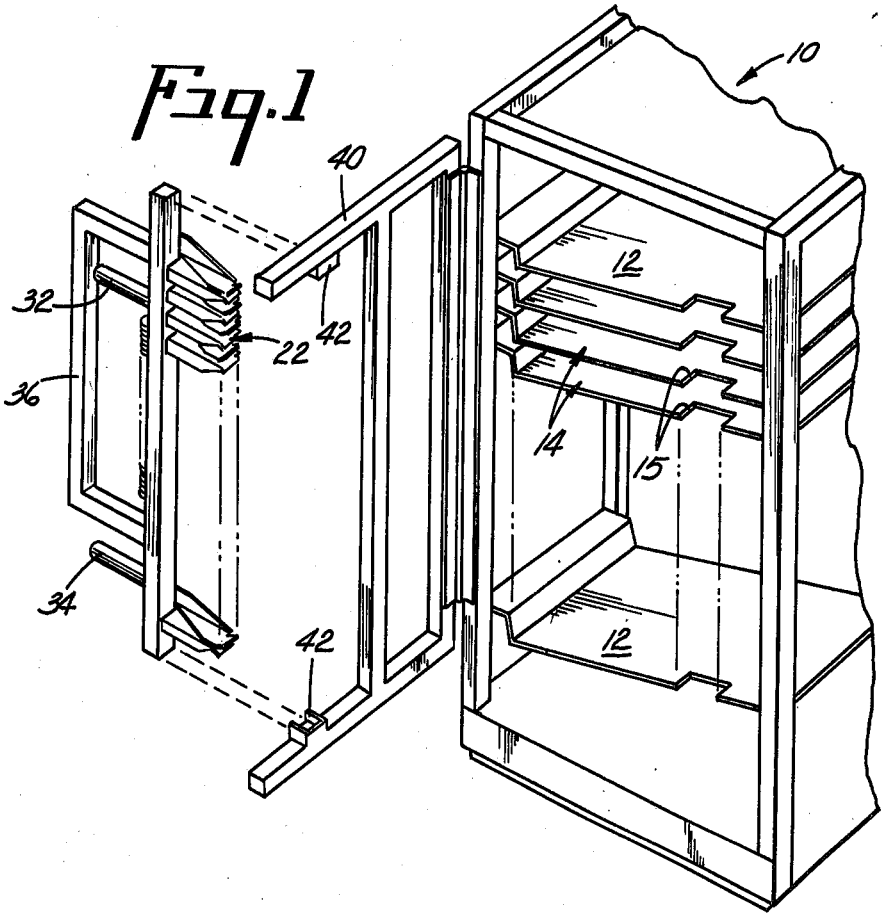
FIG. 1 is an illustration of the unloader of this invention mechanically aligned to the bins of a paper sheet collector.

The unloader device as shown in FIG. 3 is a useful and workable tool, but often it is desired to confine an unloader to one particular bin for most of the time. Also, by providing mechanical alignment the dexterity of the operator is materially reduced. Accordingly, an alignment gate 40 as shown in FIG. 1 is hinged to the frame of the collator bin stack, and the unloader is temporarily attached to the gate by means of adapter mountings 42. Thus the gate 40 may be swung toward the bin stack and the unloader gripper pads will be perfectly aligned to the bins which they are adapted to serve.

The gate is spring-urged to the open condition, so that, when approaching the sheet stacks with the unloader in position, the operator opposes the spring. Subsequently, as the operator retracts the unloader, with the stacks of sheets gripped by the unloader grippers, the gate opens, under spring action, while the operator retracting action takes place. The gate has a limited swing path and hence comes to a stop, after which, with continuing retracting action by the operator, the unloader is disengaged, and with the gripped stacks of sheets, becomes available for subsequent processing.

What is claimed is:

1. An unloader for simultaneously removing a group of two or more accumulated stacks of sheets from respective ones of a plurality of collection trays, said unloader comprising:

first and second elongated frames;

a plurality of pairs of gripper arms, each pair having a first gripper arm secured to said first frame and a second gripper arm secured to said second frame and movable relative to said first frame;

said gripper arms in each of said pairs terminating at their extremities in cooperating gripper configuration;

means coupled between said first and second frames for driving said second frames in a direction to press said first and second gripper arms in each of said pairs together in a gripping action upon an associated stack of sheets; and manually operable means for releasing said gripping action of said pairs.

2. The unloader of claim 1, in which said first and second frames respectively include two telescoped members and said driving means includes a spring interconnecting said members to drive them in a gripper direction.

3. The unloader of claim 1, in which said first frame is an external open channel and said second frame is an internal rod slidable within said external open channel.

4. The unloader of claim 1 further including releasable detent means for holding said gripper arms in an open position, whereby the unloader may be positioned without manual force continually being applied.

5. An unloader for simultaneously removing a group of two or more accumulated stacks of sheets from respective ones of a plurality of collection trays, said unloader comprising:

first and second elongated frames, said first frame being an external open channel and said second frame being an internal rod slidable within said external open channel;

a plurality of pairs of gripper arms, each pair having a first gripper arm secured to said first frame and a second gripper arm secured to said second frame and movable relative to said first frame;

said gripper arms in each of said pairs terminating at their extremities in cooperating gripper configuration;

means coupled between said first and second frames for driving said second frame in a direction to press said first and second gripper arms in each of said pairs together in a gripper action upon an associated stack of sheets; and manually operable means for releasing said gripping action of said pairs; and wherein said external open channel has two spaced elongated openings, a handle is secured through each opening to said internal rod, and said open channel has a member closely spaced and parallel to each said handle.

6. An unloader for simultaneously removing a plurality of stacks of sheets from an associated plurality of shelves, said unloader comprising:

an elongated frame of mutually interlocked relatively slidable first and second frame members;

a plurality of pairs of gripper arms, each pair having a first gripper arm secured to said first frame member and a second gripper arm secured to said second frame member;

said first and second gripper arms in each pair of gripper arms respectively having first and second terminal portions in cooperating gripper configuration, said first and second terminal portions respectively containing cooperating resilient friction pads to grip a stack of sheets and to compensate for stack height variation;

two manually operable handles spaced along said first frame member;

a grip yoke secured to said second frame member and closely spaced and parallel to each of said handles;

resilient means for urging said first and second frame members in a direction to close said friction pads with a gripping force; and releasable detent means for locking said first and second frame members in an open gripper arms condition.

* * * * *